United States Patent [19]

Lahneman, III

[11] Patent Number: 4,489,831

[45] Date of Patent: Dec. 25, 1984

[54] ADJUSTABLE STORAGE TRAY ASSEMBLY

[76] Inventor: Henry C. Lahneman, III, 233 Lawn Ave., Sellersville, Pa. 18944

[21] Appl. No.: 589,891

[22] Filed: Mar. 15, 1984

[51] Int. Cl.[3] ..... B65D 85/28; B65D 25/24; A47B 5/00; A47G 29/00

[52] U.S. Cl. ..... 206/371; 108/152; 220/18; 248/242

[58] Field of Search ..... 206/371, 214, 1.7, 1.8; 220/18; 248/217.4, 242; 108/152

[56] References Cited

U.S. PATENT DOCUMENTS

| | | | |
|---|---|---|---|
| 486,710 | 11/1892 | Fowlkes | 248/242 |
| 1,249,165 | 12/1917 | Miller . | |
| 2,306,294 | 12/1942 | Brown et al. . | |
| 2,702,649 | 2/1955 | Neilson | 220/18 |
| 3,273,846 | 9/1966 | De Mare | 211/69.1 |
| 3,517,625 | 6/1970 | Swett | 108/152 |
| 3,536,187 | 10/1970 | Stafford | 220/18 |
| 3,643,605 | 2/1972 | Miller, Jr. | 211/69.1 |
| 3,954,314 | 5/1976 | Crawford | 206/1.8 |

FOREIGN PATENT DOCUMENTS

| | | | |
|---|---|---|---|
| 302951 | 12/1928 | United Kingdom | 248/242 |

*Primary Examiner*—William T. Dixson, Jr.
*Attorney, Agent, or Firm*—Z. T. Wobensmith, III

[57] ABSTRACT

An adjustable storage tray assembly is provided, which is useful for storing various articles used on or in connection with slanted surfaces such as drafting boards, which tray can be placed directly on the surface or attached to a portion of the surface, and is adjustable to keep the top portion of the tray in a horizontal position while the bottom portion is parallel with and extends from the slanted surface.

5 Claims, 8 Drawing Figures

ADJUSTABLE STORAGE TRAY ASSEMBLY

BACKGROUND OF THE INVENTION

1. Field of the Invention

This invention relates to a storage tray assembly of the adjustable type, to be attached to a drawing board or like surface, and which is useful to support tools and the like in a horizontal position regardless of the angle of the surface on which it is placed, or to which it is mounted.

2. Description of the Prior Art

One of the problems that faces persons using drafting boards and other surfaces which are slanted, is that there are no suitable devices available to hold or store pens, pencils, erasers, drafting instruments, ink bottles or the like when the table is slanted greater than 25°. Various types of pencil cups have been provided, but they will all dump when the table angle exceeds 75°. The trend today in design and use of drafting tables is for them to be used almost at the vertical, which results in the necessity of having another table available on which to store the various described articles.

In the U.S. Pat. No. 1,249,165 to Miller, is disclosed a supporting device for drawing boards and the like, wherein the supporting device is adjustable to provide for the desired angle of use of the drawing board. A tray 24 is provided which contains drafting materials, instruments, or other articles, however, the tray is not independently adjustable from the table and is subject to dumping the articles when the table angle exceeds 25°.

The U.S. Pat. No. 2,306,294 to A.M. Brown et al., discloses a tool tray for beauty operators, wherein the cross arm 25 is mounted to the vertical back of a chair by two hooks 40. The tray can then be moved a limited amount to remain horizontal. This structure is not suitable for use with a drafting board where the stored items must be at hand, which requires the drafting board tray to be mounted to the lowermost portion of the board, or placed on the board.

The U.S. Pat. No. 3,273,846 to DeMore, discloses a draftsman's pencil holder and the like, which includes a plate 2 which is fastened to the edge of the drafting board, and supports a pencil holder tube 2 which can be rotated about the plate. This holder is not suitable for holding the desired articles, nor is it convenient in that it must be permanently mounted to the side of the board, which is often not the most convenient location.

The U.S. Pat. No. 3,643,605 to Miller, Jr., discloses an adjustable tray for a worktable, which requires a traversing bar that extends across the table from bottom to top, and is engaged at the bottom on a rail type guide 15 that must be mounted to the table. The bar carries a flat plate 50 that is mounted thereto, and adjustable to remain horizontal when the table is tilted.

The Miller structure is complicated, requires a guide to be mounted to the table, requires a transverse bar that can interfere with the use of the table, and the tray disclosed would not be suitable for table angles close to vertical since the bar would not remain on the table, and additionally the tray can not be adjusted to a useful position when the table is at extreme angles.

The U.S. Pat. No. 3,954,314 to Crawford, discloses a paint box and easel combination, wherein the box is hinged to a channel which provides an easel to receive a painting, and has a bail, which can engage in a plurality of notches in a rib in the tray for easel adjustment. This structure is not suitable for mounting to a drawing board and would not serve the functions or purposes required.

The adjustable storage tray assembly of my invention is suitable for a variety of slanted surfaces, and is adjustable to retain articles thereon in a horizontal position when the board is in various inclined positions including vertical.

SUMMARY OF THE INVENTION

This invention relates to an adjustable storage tray assembly for holding articles for use on, or in connection with slanted surfaces such as drawing boards and the like, which tray is adjustable to remain horizontal when the board or other working surface is inclined.

The principal object of the invention is to provide an adjustable storage tray that is useful with a variety of inclined surfaces.

A further object of the invention is to provide an adjustable storage tray that can be placed on or attached to an inclined surface.

A further object of the invention is to provide an adjustable storage tray that is useful to retain a wide variety of articles.

A further object of the invention is to provide an adjustable storage tray that can be easily attached and detached from an inclined surface.

A further object of the invention is to provide an adjustable storage tray that can be easily adjusted to accommodate a variety of positions of the inclined surface, and contains provisions for determining the angle of inclination..

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
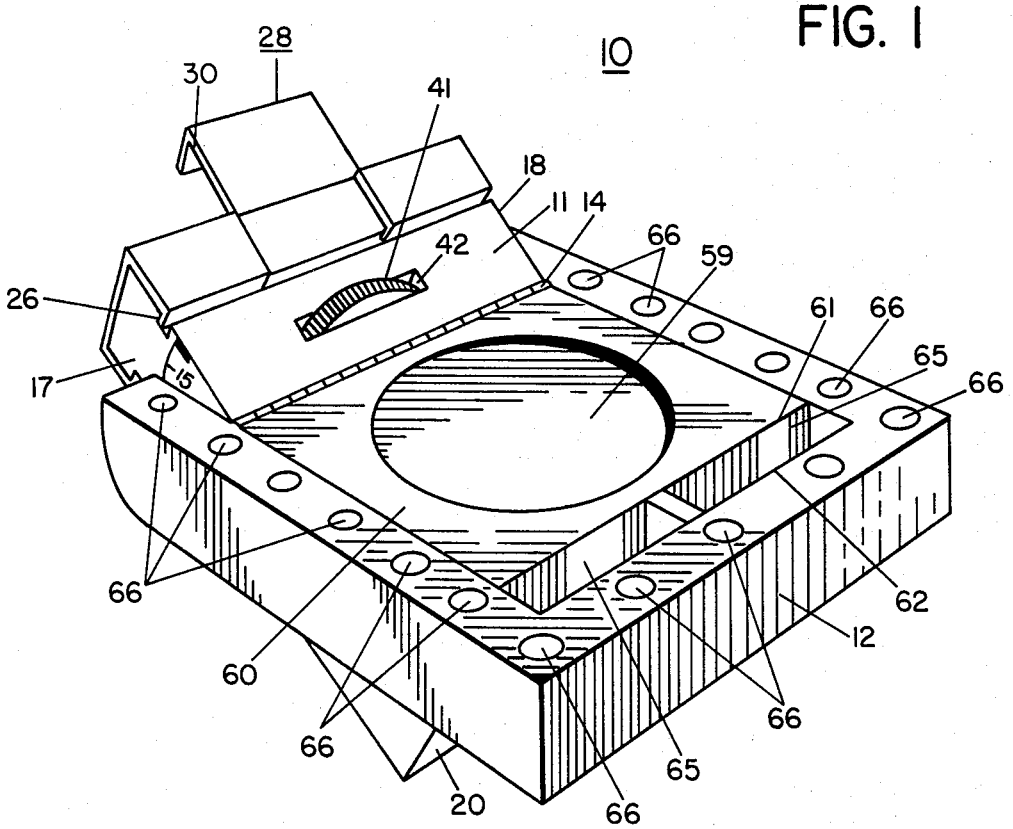
FIG. 1 is a view in perspective of the adjustable storage tray of my invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFEFFED EMBODIMENT

Referring now more particularly to the drawings, the adjustaple storage tray assembly 10 includes a base 11 and a tray 12 which are secured together by a transverse hinge 14.

The base 11 is of generally rectangular configuration with a top face 15, bottom face 16, side faces 17 and 18, front face 19 and rear face 20. The bottom face 16 is provided with feet 21 which are for use when it is desired to place the assembly 10 on an inclined surface (not shown).

Figure 3:
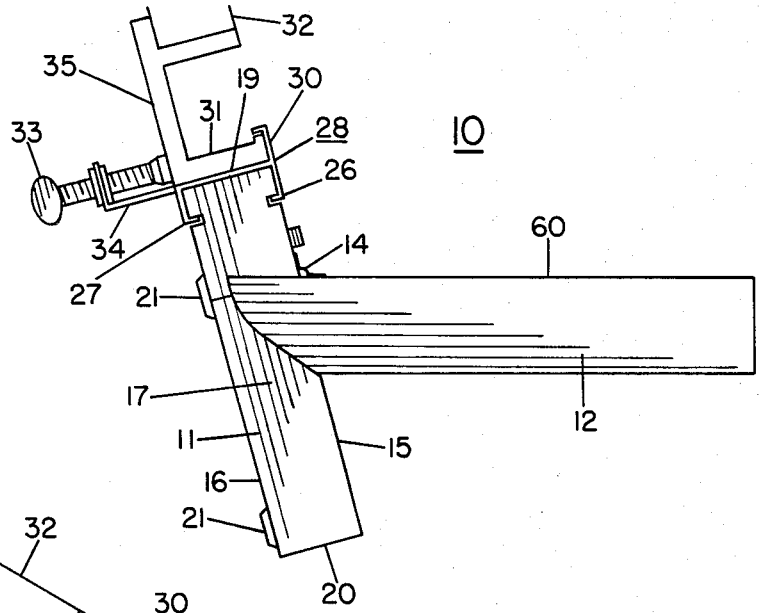
FIG. 3 is a side elevational view of the adjustable storage tray of my invention, illustrating it attached to a drawing table which is in a near vertical position.
Figure 4:
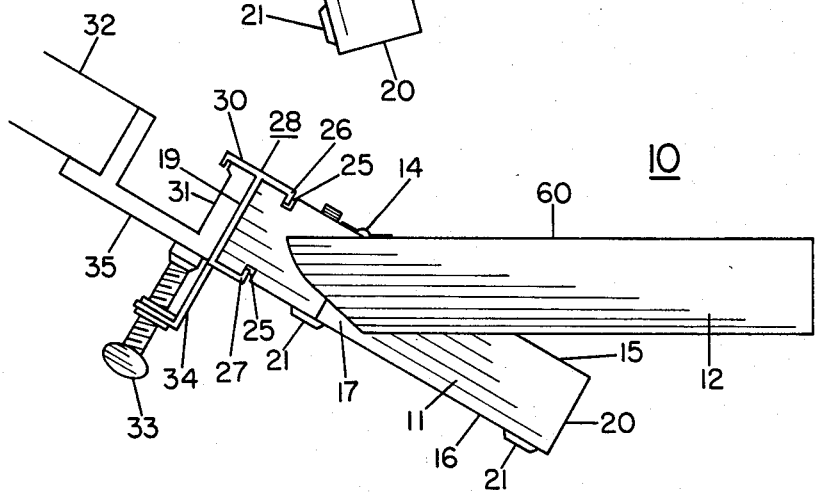
FIG. 4 is a view similar to FIG. 3 but showing the adjustable storage tray in another position, and with the drawing board in a more horizontal position.
Figure 5:
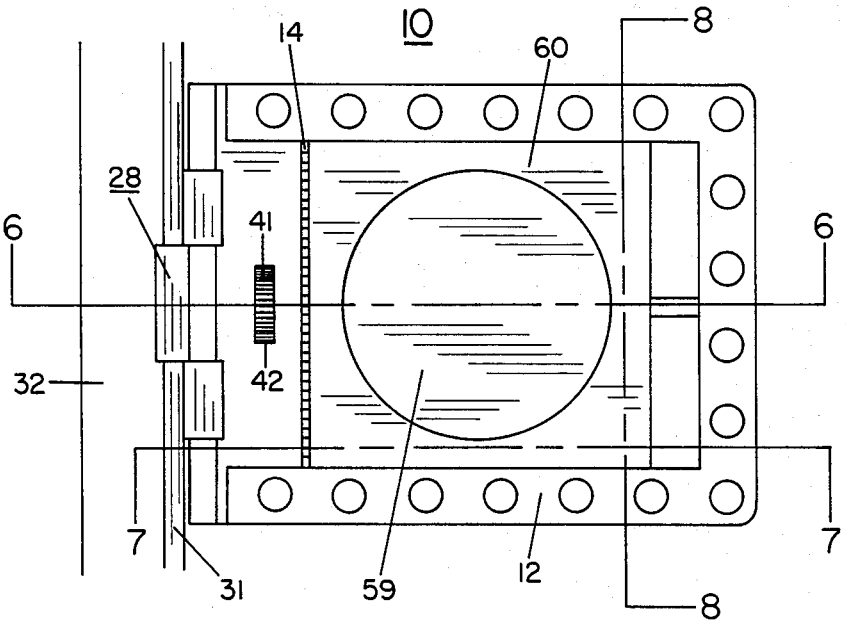
FIG. 5 is a top view of the adjustable storage tray of my invention in place on a drawing board.
Figure 6:
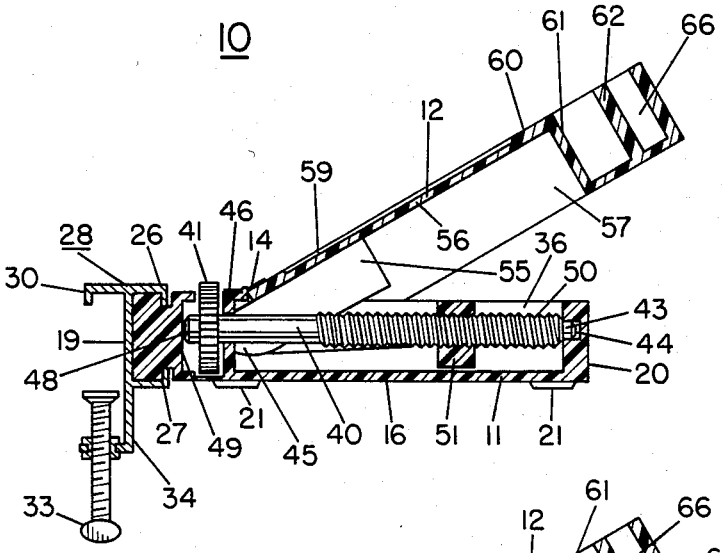
FIG. 6 is a vertical sectional view taken approximately on the line 6—6 of FIG. 5.

The top and bottom faces 15 and 16 adjacent the front face 19 are provided with transverse grooves 25 which are adapted to receive edge portions 26 and 27 of a mounting clamp 28. The clamp 28 extends around the front face 19, as well as portions of the top and bottom faces 15 and 16, and as shown in FIGS. 3 and 4 has a hook like extension 30, which is engaged with the bottom rail 31 of a drawing board 32. The clamp 28 also has a thumb screw 33 threadably engaged in a bottom leg portion 34 of clamp 28, which thumb screw 33 can engage the bottom face 35 of the drawing board 32.

The base 11 which is open at 36, is provided with a rod 40, which extends longitudinally in the base, and is provided with a grooved wheel 41 affixed to the rod, and extending above the top face 15 through slot 42.

The rod 40 has a portion 43 journaled in opening 44 in base 11 and the rod is also journaled in opening 45 in internal wall 46 of base 11, with its end 48 opposite to 43 abutting wall 49 of base 11.

The rod 40 has a threaded portion 50, which has a block 51 engaged therewith, which extends across the base at 36, and is provided with pins 52, each of which is engaged with a link 53. The links 53 are engaged with pins 54 carried on vertical plates 55, which are attached to the top wall panel 56 of the tray 12 adjacent the downwardly extending sides 57, which extend outside of the base 11. The tray 12 is also provided with a circular depressed portion 59 in the top face 60 of tray 12 to retain items (not shown) therein. The top wall panel 56 has additional downwardly extending end panels 61 and 62, which form receptacles 65 for articles (not shown) to be retained therein.

The top wall panel 56 also has circular recesses 66 around the outside of the tray 12, for the reception of pencils, pens and other circular items (not shown).

Figure 2:
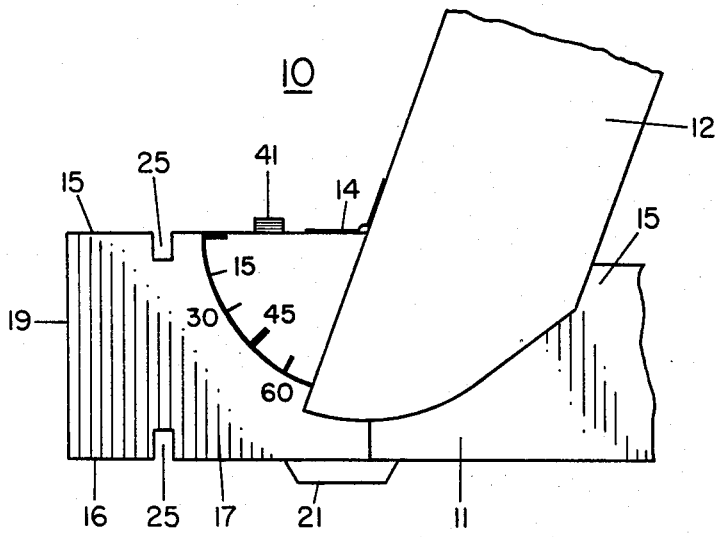
FIG. 2 is a fragmentary side elevational view, enlarged, of a portion of the adjustable storage tray of my invention as shown in FIG. 1.

As shown more particularly in FIG. 2, the base 11 may be provided with numerical indicia on the side face 17, to indicate the angle of inclination of the tray 12 with respect to the base 11.

The mode of operation will now be pointed out.

Figure 7:
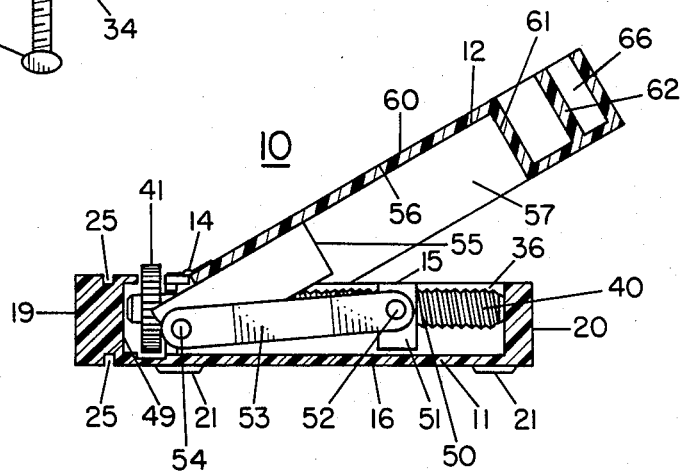
FIG. 7 is a vertical sectional view taken approximately on the line 7—7 of FIG. 5.
Figure 8:
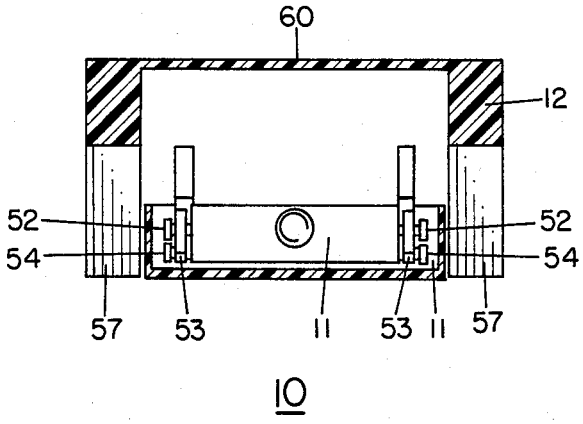
FIG. 8 is an end elevational view of the adjustable storage tray of my invention.

As shown in FIGS. 2, 7 and 8, when it is desired to use the adjustable storage tray assembly 10 directly on an inclined surface (not shown), the mounting clamp 28 is not used. The assembly 10 has its feet 21 placed on the surface (not shown) where desired. The wheel 41 is engaged by the users fingers (not shown) and the wheel 41 rotated to rotate the threaded rod 40 and move block 51 in the desired direction to move links 53, to pivot the tray 12 about hinge 14 until tray 12 is at the desired angle. The tray 12 can then have the required articles placed therein or thereon.

If use is desired with attachment to an inclined surface, the clamp 28 is slid over the end of the base 11 with its edge portions 26 and 27 engaged in grooves 25. The extension 30 can be engaged with the rail 31, and thumb screw 33 tightened to retain the clamp 28 thereon.

The wheel 41 can then be rotated to move tray 12 to the horizontal or other desired position as previously described with observation of the angle of inclination available, and the tray 12 can then be used to hold the required articles.

It will thus be seen that structure has been provided with which the objects of the invention are attained.

I claim:

1. An adjustable storage tray assembly for use with inclined surfaces which comprises a base, a tray hingedly secured to said base, link means connecting said tray and said base, and means carried by said base engaged with said link means for varying the relative angular position of said base and said tray.

2. An adjustable storage tray assembly as defined in claim 1 in which said inclined surface is provided with an end rail, and a clamp is provided engaged with said end rail and said base for detachably fastening said base to said end rail.

3. An adjustable storage tray assembly as defined in claim 1 in which said second mentioned means includes a rotatable threaded rod carried longitudinally in said base, a wheel engaged with said rod for rotation thereof, a block engaged with said threaded rod, and movable therealong which block has pivot pins extending therefrom, and said link means is a pair of links pivotedly engaged with said pivot pins in said block and with a pair of pivot pins carried on plates attached to said tray.

4. An adjustable storage tray assembly as defined in claim 1 in which indicia are provided on said base to indicate with said tray the relative inclination therebetween.

5. An adjustable storage tray assembly as defined in claim 1 in which said tray is provided with a depressed portion, and a plurality of circular recesses to retain articles to be carried by said assembly.

* * * * *